US008316681B2

(12) United States Patent
Nakayama et al.

(10) Patent No.: US 8,316,681 B2
(45) Date of Patent: Nov. 27, 2012

(54) ROLLING MILL

(75) Inventors: Katsumi Nakayama, Yokohama (JP); Hisashi Honjou, Yokohama (JP)

(73) Assignee: IHI Corporation (JP)

( * ) Notice: Subject to any disclaimer, the term of this patent is extended or adjusted under 35 U.S.C. 154(b) by 321 days.

(21) Appl. No.: 12/864,266

(22) PCT Filed: Feb. 6, 2009

(86) PCT No.: PCT/JP2009/052103

§ 371 (c)(1),
(2), (4) Date: Jul. 23, 2010

(87) PCT Pub. No.: WO2009/099214

PCT Pub. Date: Aug. 13, 2009

(65) Prior Publication Data

US 2010/0294012 A1 Nov. 25, 2010

(30) Foreign Application Priority Data

Feb. 8, 2008 (JP) ..... 2008-029410

(51) Int. Cl.
*B21B 15/00* (2006.01)

(52) U.S. Cl. ..... 72/206

(58) Field of Classification Search ..... 72/206, 72/247; 29/527.7

See application file for complete search history.

(56) References Cited

U.S. PATENT DOCUMENTS 4,519,233 A * 5/1985 Feldmann et al. ..... 72/241.4
4,800,742 A * 1/1989 Feldmann et al. ..... 72/247
4,881,396 A * 11/1989 Seidel et al. ..... 72/247
4,955,221 A * 9/1990 Feldmann et al. ..... 72/247
5,655,397 A * 8/1997 Satoh et al. ..... 72/241.4

(Continued)

FOREIGN PATENT DOCUMENTS

JP 63-174709 7/1988

(Continued)

OTHER PUBLICATIONS

Decision on Grant issued in corresponding Russian Patent Application No. 2010136293/02 dated Jul. 1, 2011 (with English translation) 10 pages.

(Continued)

*Primary Examiner* — Faye Francis
(74) *Attorney, Agent, or Firm* — Ostrolenk Faber LLP

(57) ABSTRACT

A rolling mill, including: a casting device that casts molten metal to form a slab with a predetermined width; a pair of finishing milling rolls that shape the slab by rolling; and a movement device capable of moving the finishing milling rolls along respective axis directions thereof, in which a contour of a peripheral surface of each of the finishing milling rolls has a shape in which a first contour and a second contour are overlapped, the first contour including: edge regions with a shape in accordance with an average value of thickness variation in edge portions so as to make uniform a rolling reduction in a width direction for the slab with an edge thickness equal to the average value; and a central region that is interposed between the edge regions, and the second contour including edge regions which have an inclination angle steeper with respect to the axis direction than a central region so that the distance between facing edge portions of one of the pair of finishing milling rolls and the other of the pair of finishing milling rolls changes when the finishing milling rolls are moved by the movement device in opposite directions.

6 Claims, 4 Drawing Sheets

U.S. PATENT DOCUMENTS

| | | | | |
|---|---|---|---|---|
| 5,943,896 | A * | 8/1999 | Rosenthal et al. | 72/252.5 |
| 6,324,881 | B1 * | 12/2001 | Benedetti et al. | 72/247 |
| 8,191,392 | B2 * | 6/2012 | Kikkawa | 72/252.5 |

FOREIGN PATENT DOCUMENTS

| | | |
|---|---|---|
| JP | 8-192208 | 7/1996 |
| JP | 2002-11503 | 1/2002 |
| JP | 2007-7696 | 1/2007 |
| KR | 10-0307111 | 8/2001 |
| RU | 2 146 973 | 3/2000 |
| RU | 2 268 795 | 1/2006 |
| RU | 2 280 518 | 7/2006 |

OTHER PUBLICATIONS

International Search Report and Written Opinion mailed Apr. 14, 2010 in corresponding PCT International Application No. PCT/JP2009/052103.

Office Action dated May 3, 2012 issued in corresponding Korean Patent Application No. 10-2010-7018904 (with English translation) 6 pages.

* cited by examiner

ROLLING MILL

CROSS-REFERENCE TO RELATED APPLICATIONS

The present application is a 35 U.S.C. §§371 national phase conversion of PCT/JP2009/052103, filed Feb. 6, 2009, which claims priority of Japanese Patent Application No. 2008-029410, filed Feb. 8, 2008, the contents of which are incorporated herein by reference. The PCT International Application was published in the Japanese language.

TECHNICAL FIELD

The present invention relates to a rolling mill that casts molten metal to form a slab and further shapes the slab.

BACKGROUND ART

There are conventionally known rolling mills that cast molten metal between casting rolls installed in a casting device to form a plate-like slab, and further shape the slab by rolling it between finishing milling rolls.

In such rolling mills, there are cases where, when the molten metal is cast between the casting rolls, a thickness variation is produced in the slab at its edge portions in its width direction due to thermal deformation or the like of the casting rolls, resulting in a so-called edge drop or edge up.

For example, in the case where a slab with such an edge drop or edge up is rolled between a pair of rolls whose peripheral surface has a linear contour shape, a pressure difference is produced between the rolling reduction force acting on the central portion of the slab in its width direction and the rolling reduction force acting on its edge portions. This leads to a non-uniform rolling reduction in the width direction of the slab. As a result, a difference in the extension ratio is produced between the central portion and the edge portions, leading to a defective shape such as corrugation in a slab shape.

Therefore, Patent Document 1 discloses a rolling mill in which a contour shape of a peripheral surface of both finishing milling rolls is configured to have edge portions with an inclination angle steeper with respect to the axis direction than that of a central portion.

According to such a rolling mill as disclosed in Patent Document 1, a movement device is used to move one finishing milling roll and the other finishing milling roll in directions opposite to each other along the axis direction, making it possible to change the distance between the facing edge portions of the work rolls. Therefore, a thickness variation in the edge portions in the width direction of the slab that is cast between the casting rolls is measured, and the movement device is used to move the finishing milling rolls over time based on the measurement result, to thereby render it possible to always make uniform the rolling reduction in the width direction of the slab by the finishing milling rolls.

[Patent Document 1] Japanese Unexamined Patent Application, First Publication No. 2002-11503

DISCLOSURE OF THE INVENTION

Problems to be Solved by the Invention

However, the movement device for moving the finishing milling roll is typically provided with a hydraulic system. Therefore, due to an operation failure or the like of a hydraulic valve, an initial failure is likely to occur especially at the start of the operation of the rolling mill.

Furthermore, to respond to a thickness variation in the slab, it is required to accurately move the finishing milling rolls many times. Especially when casting is performed with a so-called continuous casting machine in which casting is continuously performed by a casting device, an edge drop produced in the slab becomes very large. Therefore, it is required to accurately move the finishing milling rolls many times. Thus, in the case where the finishing milling rolls are to be moved accurately many times, there is a possibility that a heavy burden is applied to the finishing milling rolls and the movement device and that the movement of the finishing milling rolls produces a displacement of the slab in the width direction to cause a defective shape of the slab.

In addition, because the finishing milling rolls are required to be moved accurately, adjustment of the movement device takes time. Therefore, once an operational failure occurs in the movement device, there arises a necessity of stopping the operation of the rolling mill for a long period of time.

In this manner, the rolling mill shown in Patent Document 1 suffers from a multitude of troubles caused by the movement device. When there occurs trouble caused by the movement device, there arises a necessity of stopping the operation of the rolling mill for a long period of time.

The present invention has been achieved in view of the aforementioned problems, and has as an object the provision of a rolling mill with a movement device for moving its finishing milling rolls which can reduce trouble caused by the movement device.

Means for Solving the Problems

A rolling mill according to the present invention includes: a casting device that casts molten metal to form a slab with a predetermined width; a pair of finishing milling rolls that shape the slab by rolling; and a movement device capable of moving the finishing milling rolls along respective axis directions thereof, in which a contour of a peripheral surface of each of the finishing milling rolls has a shape in which a first contour and a second contour are overlapped, the first contour including: edge regions with a shape in accordance with an average value of thickness variation in edge portions so as to make uniform a rolling reduction in a width direction for the slab with an edge thickness equal to the average value; and a central region that is interposed between the edge regions, and the second contour including edge regions which have an inclination angle steeper with respect to the axis direction than a central region so that the distance between facing edge portions of one of the pair of finishing milling rolls and the other of the pair of finishing milling rolls changes when the finishing milling rolls are moved by the movement device in opposite directions.

According to the rolling mill of the present invention, the contour of the finishing milling roll has a shape in which a first contour and a second contour are overlapped. The first contour includes: edge regions with a shape in accordance with an average value of thickness variation in edge portions so as to make uniform a rolling reduction in a width direction for the slab with an edge thickness equal to the average value; and a central region that is interposed between the edge regions. The second contour includes edge regions which have an inclination angle steeper with respect to the axis direction than a central region so that the distance between facing edge portions of one finishing milling roll and the other finishing milling roll changes when the finishing milling rolls are moved by the movement device in opposite directions.

In the present embodiment, it is preferable that the first contour have a shape axisymmetrical with respect to a line passing through a central position in a length direction along the axis of the finishing milling roll.

In the present embodiment, it is preferable that the second contour have a shape symmetrical with respect to a central position in a length direction along the axis of the finishing milling roll.

In the present embodiment, it is preferable that the central region of the first contour be curved in accordance with a warpage amount of the finishing milling roll at the time of rolling.

In the present embodiment, it is preferable that the first contour and the second contour be generally smoothly continuous.

In the present embodiment, it is preferable that the casting device continuously cast the metal, and that the finishing milling rolls continuously shape the slab.

Advantageous Effects of the Invention

The finishing milling rolls of the present invention have both the workings obtained when rolls whose peripheral surface has the first contour are used as finishing milling rolls and the workings obtained when rolls whose peripheral surface has the second contour are used as finishing milling rolls. That is, when not moved by the movement device, the pair of finishing milling rolls of the present embodiment rolls a slab so that a rolling reduction in the width direction is uniform for the slab with an edge thickness equal to an average value of thickness variation in the edge portions. In addition, when one finishing milling roll and the other finishing milling roll are moved by the movement device in opposite directions, the distance between the facing edge portions of the finishing milling rolls is changed and the slab is rolled in accordance with a thickness variation over time of the edge portions.

Therefore, with the movement of the finishing milling rolls by the movement device, it is possible to perform rolling in accordance with the thickness variation over time of the edge portions of the slab. Furthermore, even in the case where the finishing milling rolls are not moved by the movement device, it is possible to perform rolling such that a rolling reduction in the width direction is uniform for the slab with an edge thickness equal to an average value of thickness variation in the edge portions. A thickness variation in the edge portions of an actual slab (a slab whose edge thickness varies over time) is not significantly different from its average value. Therefore, even in the case where the finishing milling rolls are not moved by the movement device, it is possible to roll the slab to a degree that does not cause a deterioration in its quality.

As a result, even in the event of trouble in the movement device, it is possible to operate the rolling mill without waiting for the recovery of the movement device.

In the actual operation of the rolling mill, there are cases where a preset quality of the final form of the slab permits some degree of thickness variation in the edge portions. In such cases, it is possible to operate the rolling mill in a state where the movement device is at rest, according to the present embodiment. Therefore, it is possible to reduce the frequency of use of the movement device. Hence, it is possible to reduce the amount of trouble in the movement device.

As a result, according to the present invention, it is possible to reduce the amount of trouble in a rolling mill that is caused by the movement device provided in the rolling mill for moving its finishing milling rolls.

DESCRIPTION OF THE REFERENCE SYMBOLS

X1: LIQUID METAL
X2: SLAB
X3: THIN PLATE
S1: ROLLING MILL
1: CASTING DEVICE
2: FINISHING MILLING DEVICE
21: WORK ROLL (FINISHING MILLING ROLL)
21*a*: LOWER WORK ROLL (FINISHING MILLING ROLL)
21*b*: UPPER WORK ROLL (FINISHING MILLING ROLL)
A: CONTOUR
A1: CENTRAL REGION
A2, A3: EDGE REGION
B: FIRST CONTOUR
B1: CENTRAL REGION
B2, B3: EDGE REGION
C: THIRD CONTOUR
C1: CENTRAL REGION
C2, C3: EDGE REGION

BEST MODE FOR CARRYING OUT THE INVENTION

Hereunder is a description of one embodiment of a rolling mill according to the present invention with reference to the drawings. In the following drawings, scale ratios among the constituent elements are appropriately modified to make their size recognizable. Especially in the following drawings (FIG. 2, FIG. 3, and FIG. 5), scale ratios of finishing milling rolls in the direction orthogonal to the axis direction are shown to be extremely high, which emphasizes the contours of the peripheral surfaces of the finishing milling rolls. However, the actual change in the contour of the peripheral surface of the finishing milling roll is approximately 0.1 mm. Therefore, when observed visually, the contour is substantially straight.

Figure 1:
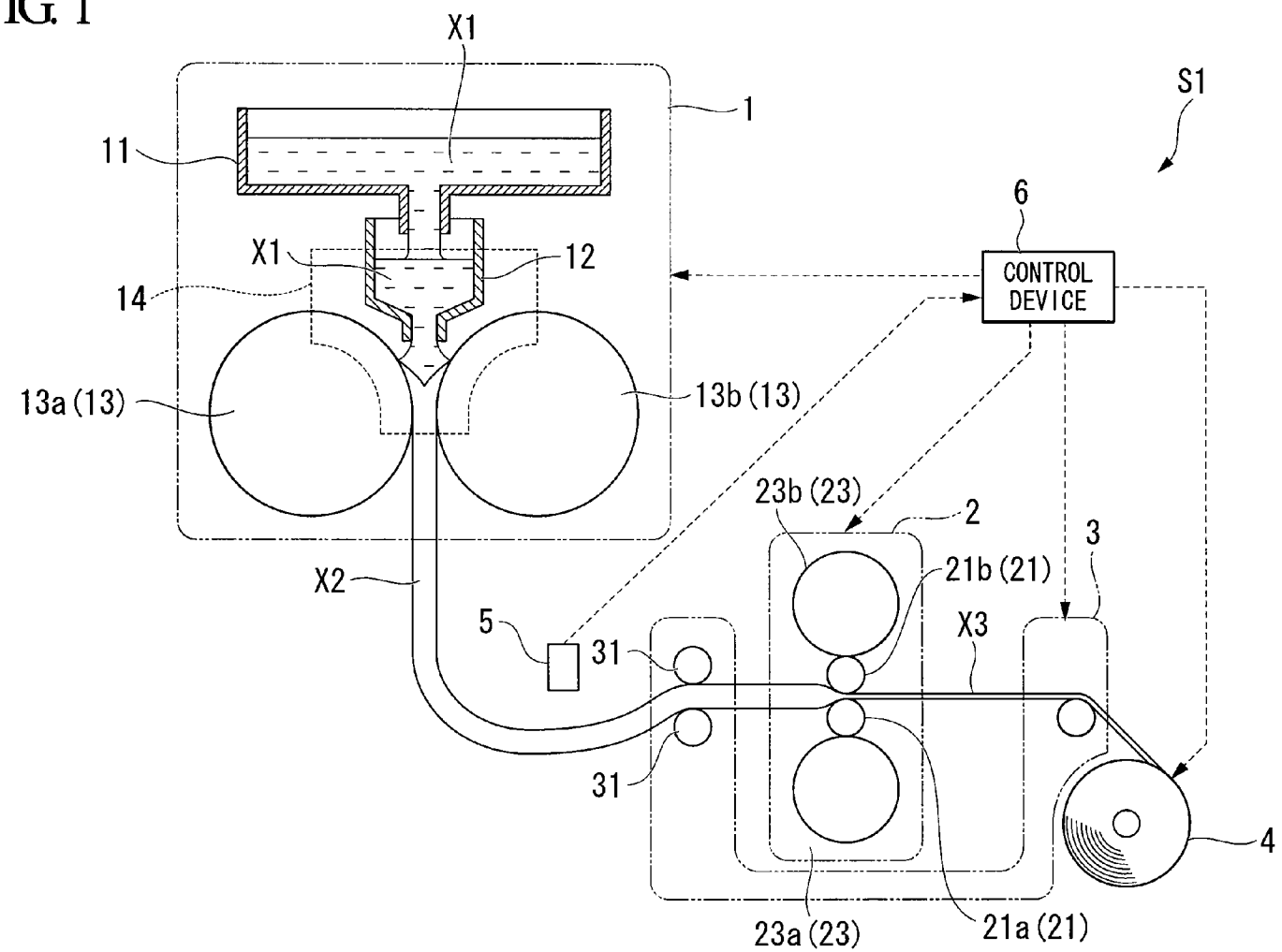
FIG. 1 is a schematic diagram showing a rough construction of a rolling mill according to one embodiment of the present invention.

FIG. 1 is a schematic construction diagram showing a rough construction of a rolling mill S1 according to the present embodiment. As shown in the drawing, the rolling mill S1 of the present embodiment includes: a casting device 1; a finishing milling device 2; a guide device 3; a winding device 4; a thickness sensor 5; and a control device 6.

The casting device 1 casts a liquid metal X1 to form a slab X2 with a predetermined width. The casting device 1 includes: a tundish 11; a liquid metal casting nozzle 12; casting rolls 13; and a side weir 14.

The tundish 11 is a bath for temporarily reserving the liquid metal X1 in order to remove inclusions in the liquid metal X1 supplied from the outside. The tundish 11 is capable of exhausting the reserved liquid metal X1 downward.

The liquid metal casting nozzle 12 receives the liquid metal X1 exhausted from the tundish 11, and also guides and supplies the liquid metal X1 to the casting rolls 13. The liquid metal casting nozzle 12 is arranged below the tundish 11 and above the casting rolls 13.

The casting rolls 13 are made of a pair of a casting roll 13*a* and a casting roll 13*b* that are horizontally arranged. The casting rolls 13 shape the liquid metal X1, which is supplied from the above casting nozzle 12, between the casting roll 13*a* and the casting roll 13*b* while cooling the liquid metal X1, to make the plate-like slab X2 and exhaust it downward.

The side weir 14 is a plate member for preventing the liquid metal X1 supplied to the casting rolls 13 from leaking out from the side portions (edge portions in the axis direction) of the casting rolls 13. The side weir 14 is installed so as to be slidable with respect to the side surfaces of the casting rolls 13.

The space surrounded by the peripheral surfaces of the casting rolls 13 and the side weir 14 functions as a reservoir. The liquid metal X1 supplied from the liquid metal casting nozzle 12 to the casting rolls 13 is reserved in the reservoir, and is then supplied to the casting roll 13*a* and the casting roll 13*b*.

The finishing milling device 2 rolls and shapes the slab X2 into a thin plate X3. The finishing milling device 2 is arranged on the downstream side of the casting device 1 in the flowing direction of the slab.

The finishing milling device 2 includes: work rolls 21 (finishing milling rolls); a movement device 22 (see FIG. 2); and back-up rolls 23.

The work rolls 21 are made of a lower work roll 21*a* and an upper work roll 21*b* that are arranged in the up-down direction. The work rolls 21 roll the slab X2 between the lower work roll 21*a* and the upper work roll 21*b* to make the slab X2 into the thin plate X3, and then exhausts the thin plate X3.

The movement device 22 includes: a movement device 22*a* that moves the lower work roll 21*a* in its axis direction; and a movement device 22*b* that moves the upper work roll 21*b* in its axis direction.

The back-up rolls 23 are in contact with the work rolls 21 in order to suppress the warpage of the work rolls 21. The back-up rolls 23 are made of: a back-up roll 23*a* in contact with the lower work roll 21*a*; and a back-up roll 23*b* in contact with the upper work roll 21*b*.

Figure 2:
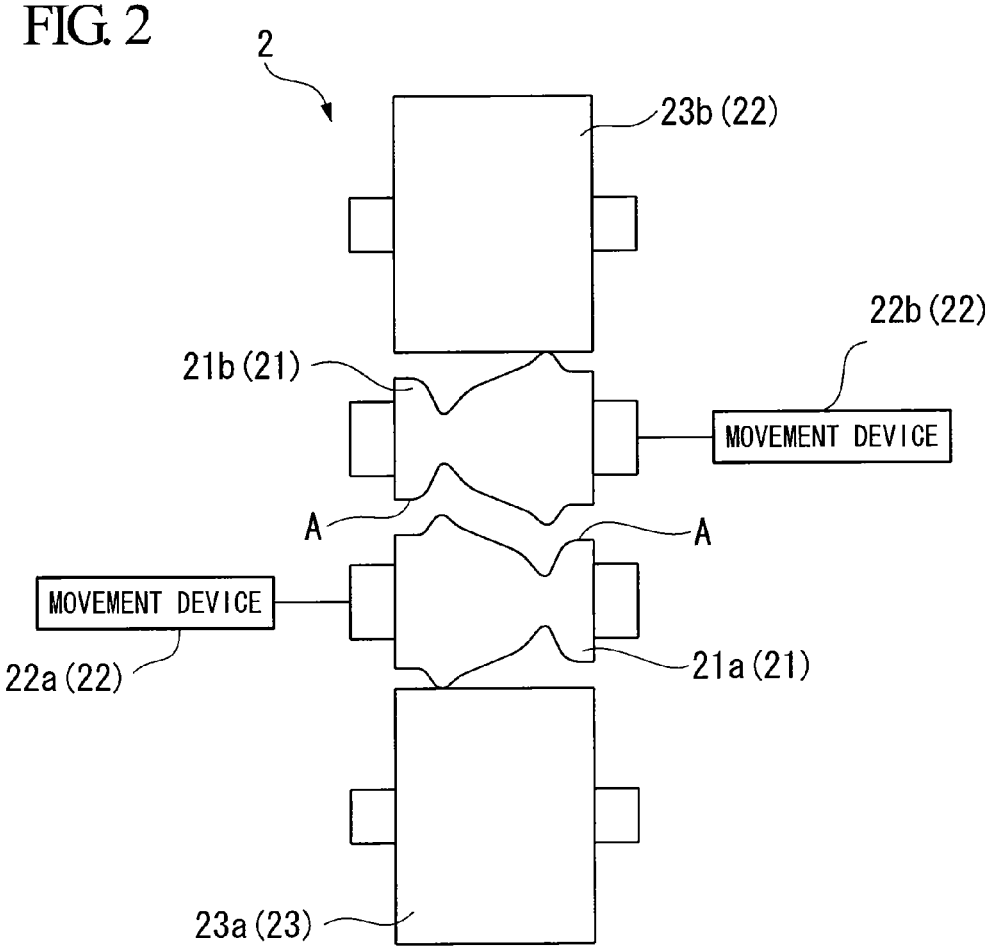
FIG. 2 is a schematic construction diagram of a finishing milling device provided in the rolling mill according to one embodiment of the present invention.

FIG. 2 is an enlarged view of the finishing milling device 2. As shown in the drawing, in the rolling mill S1 of the present embodiment, an outer shape of the cross-section along the axis of the work roll 21 of the finishing milling device 2 (hereinafter, referred to as "contour A of the peripheral surface" or simply as "contour A") is configured to be a special curved shape. That is, the peripheral surface of the work roll 21 is a surface formed by the contour A with the special curved surface (see FIG. 3) being rotated about the axis.

Below, an outer shape of the cross-section along the axis of the work roll will be referred to as "contour of the peripheral surface" or simply as "contour." In other words, in the present embodiment, the contour of the peripheral surface of the work roll is represented by a boundary of the peripheral surface in a projection drawing when the work roll is projected from the direction orthogonal to the axis.

Figure 3:
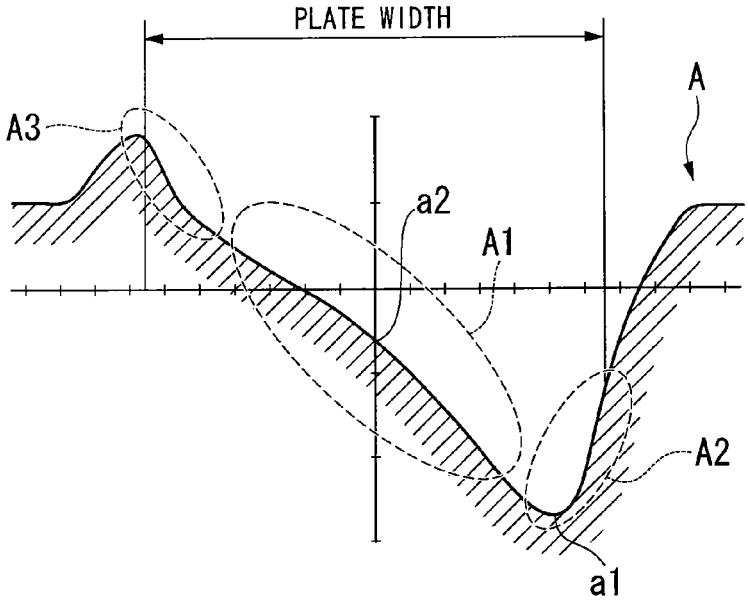
FIG. 3 is a graph showing a shape of a contour of a peripheral surface of finishing milling rolls provided in the rolling mill according to one embodiment of the present invention.

Hereunder is a detailed description of the contour A of the peripheral surfaces of the work rolls 21 provided in the rolling mill S1 of the present embodiment. FIG. 3 is a graph showing a displacement amount of the contour A of the peripheral surface of the lower work roll 21*a* from a reference position. In the present embodiment, the reference position refers to a position of the contour in the case where the peripheral surface of the work roll is not curved but flat.

As shown in FIG. 3, in the contour A of the peripheral surface of the lower work roll 21*a* within the range of the plate width of the slab X2, an edge region A2 on one side (an edge region on the right in FIG. 3) has a curved shape which gradually sinks deeper from the reference position toward the axis, and after an inflection point a1, bulges more in the direction away from the axis, as it is closer to a central region A1. The central region A1 has a shape that gradually bulges from the edge region A2 to an edge region A3 on the other side (an edge region on the left in FIG. 3) in the direction away from the axis. The edge region A3 on the other side has a curved shape that bulges past the bulge amount of the central region A1 as it is further away from the central region A1.

A center a2 of the contour A in the range of the plate width of the slab X2 sinks approximately 0.03 mm from the reference position toward the axis, as shown in FIG. 3.

The contour A of the peripheral surface of the work roll 21 is formed by overlapping an outer shape of the cross-section along the axis of a work roll 100 (described later) shown in FIG. 5 (hereinafter, referred to as "first contour B") with an outer shape of the cross-section along the axis of a work roll 200 (described later) shown FIG. 7 (hereinafter, referred to as "second contour C"). The first contour B includes: edge regions B2, B3 with a shape in accordance with an average value of the thickness variation in edge portions so as to make uniform a rolling reduction in the width direction for the slab with an edge thickness equal to the average value; and a central region B1 between the edge regions B2, B3. The second contour C includes edge regions C2, C3 which have an inclination angle steeper with respect to the axis direction than a central region C1 so that the distance between facing edge portions of the lower work roll and the upper work roll will change when the work rolls are moved by the movement device in axially opposite directions.

Figure 4:
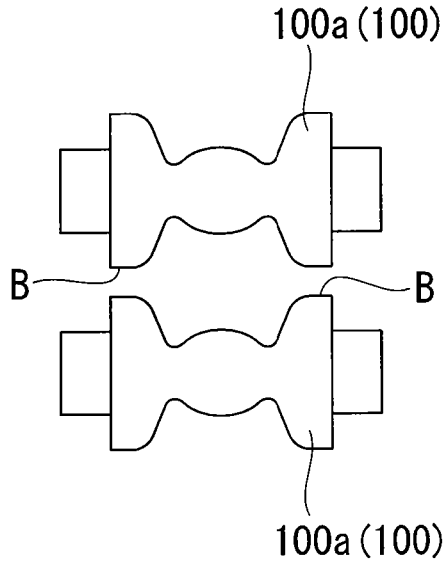
FIG. 4 is a schematic construction diagram showing work rolls including only a first contour that constitutes the contour of the peripheral surface of the work rolls provided in the rolling mill according to one embodiment of the present invention.

FIG. 4 is a schematic construction diagram showing the work rolls 100 made of: a lower work roll 100*a*; and an upper work roll 100*b*, whose peripheral surfaces form the first contour B. FIG. 5 is a graph showing a displacement amount of the first contour B from the reference position.

Figure 5:
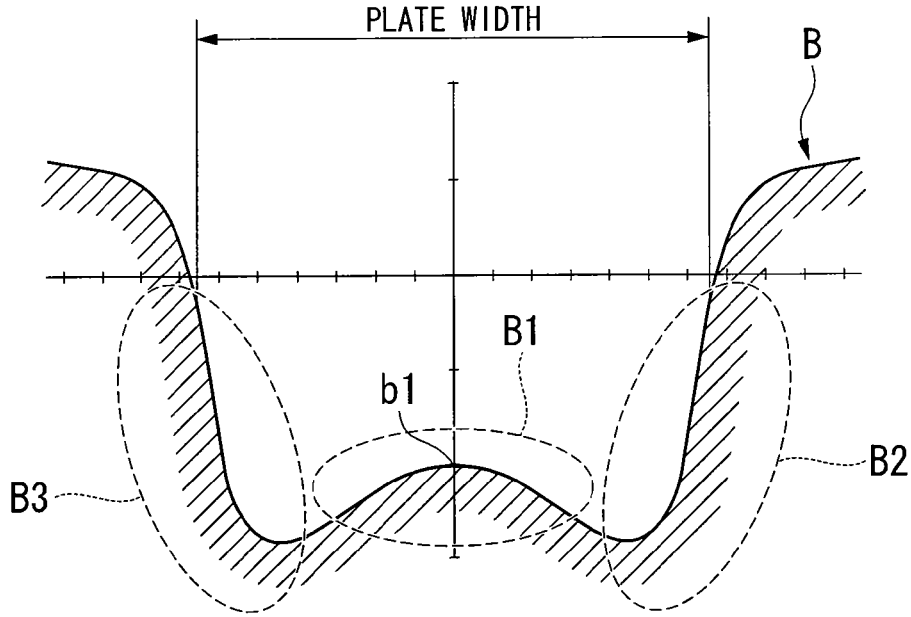
FIG. 5 is a graph showing the first contour that constitutes the contour of the peripheral surface of the work rolls provided in the rolling mill according to one embodiment of the present invention.

As shown in FIG. 5, the edge region B2 on one side and the edge region B3 on the other side have a shape in accordance with an edge portion of a slab with an edge thickness equal to an average value of the thickness variation in the edge portions. A region that is interposed between the edge region B2 and the edge region B3 is the central region B1. The first contour B is generally smoothly continuous from the edge region B2 to the edge region B3. According to the work rolls 100 with the peripheral surface having the first contour B, a rolling reduction in the width direction is uniform for the slab with thicknesses in edge portions equal to the average value of the thickness variation in the edge portions.

That is, the first contour B includes: the edge regions B2, B3 with a shape in accordance with edge portions of a slab with an edge thickness equal to an average value of the thickness variation in the edge portions so as to make uniform a rolling reduction in the width direction for the slab; and a central region B1 between the edge regions B2, B3.

Here, the slab is rolled between the lower work roll 100*a* and the upper work roll 100*b*. At this time, the central portions of the lower work roll 100*a* and the upper work roll 100*b* in their respective axis directions are pressed by the slab and warped toward their respective axes. In order to cancel the warpage, the central region B1 of the first contour B is formed in a curved manner in a direction further away from the axis according to the warpage amount. This straightens the outer shape of the cross-section along the axis of the lower work roll 100*a* at its central portion and the outer shape of the cross-section along the axis of the upper work roll 100*b* at its central portion when the slab is rolled therebetween. As a result, it is possible to make a rolling reduction for the central portion of the slab in its width direction further uniform.

The first contour B has a shape axisymmetrical with respect to a line passing through a central position b1 in a length direction along the axis.

Figure 6:
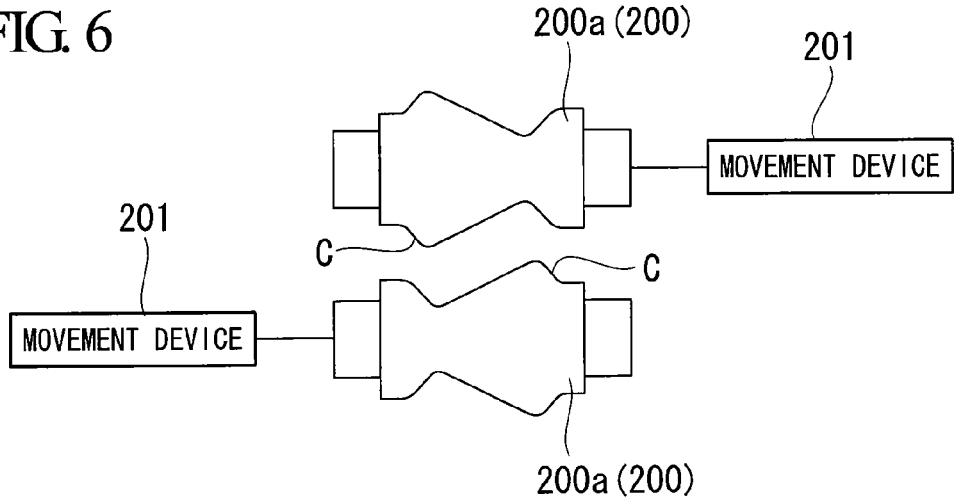
FIG. 6 is a schematic construction diagram a work roll including only a second contour that constitutes the contour of the peripheral surface of the work rolls provided in the rolling mill according to one embodiment of the present invention.

FIG. 6 is a schematic construction diagram of the work rolls 200 made of a lower work roll 200*a* and an upper work roll 200*b*, whose peripheral surfaces form the second contour C. FIG. 7 is a graph showing a displacement amount of the second contour C from the reference position in the lower work roll 200*a*.

Figure 7:
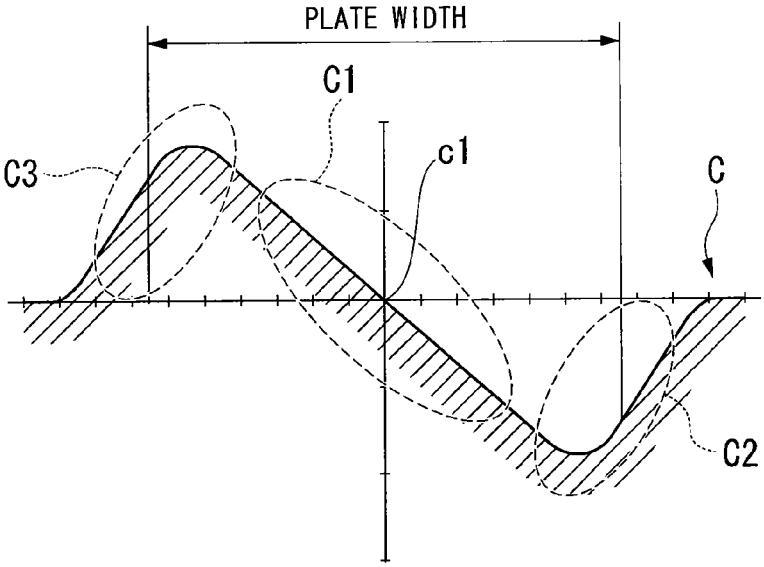
FIG. 7 is a graph showing the second contour that constitutes the contour of the peripheral surface of the work rolls provided in the rolling mill according to one embodiment of the present invention.

As shown in FIG. 7, edge regions C2, C3 have an inclination angle steeper with respect to the axis direction than a substantially linear central region C1 so that the distance between the facing edge portions of the lower work roll 200*a* and the upper work roll 200*b* will change when the work rolls are moved by a movement device 201 in axially opposite directions. The second contour C is generally smoothly continuous from the edge region C2 to the edge region C3. The second contour C shown in FIG. 7 is for the lower work roll 200*a*. The second contour C in the upper work roll 200*b* has a shape formed by the second contour C of the lower work roll 200*a* shown in FIG. 7 being rotated 180° about a central position c1 in a length direction along its axis. According to the work rolls 200 with the peripheral surface having the second contour C, the distance between the facing edge portions of the lower work roll 200*a* and the upper work roll 200*b* change when the work rolls are moved by the movement device 201 shown in FIG. 6 in axially opposite directions. Therefore, the thickness variation at the edge portions in the width direction of the slab that is cast between the casting rolls is measured, and the work rolls are moved over time by the movement device 201 based on the measurement result, to thereby make it possible to always make uniform a rolling reduction for the slab in its width direction between the work rolls.

The second contour C has a shape symmetrical with respect to the central position c1 in the length direction along the axis.

In the rolling mill S1 of the present embodiment, the contour A of the peripheral surface of the work roll 21 has a shape in which the aforementioned first contour B and the aforementioned second contour C are overlapped. Therefore, the work rolls 21 of the present embodiment have both the workings obtained when rolls whose peripheral surface has the first contour B are used as work rolls and the workings obtained when rolls whose peripheral surface has the second contour C are used as work rolls. That is, when not moved by the movement device 22, the pair of work rolls 21 in the rolling mill S1 of the present embodiment roll the slab X2 so that a rolling reduction in the width direction is uniform for a slab with an edge thickness equal to an average value of the thickness variation in the edge portions. In addition, when the lower work roll 21*a* and the upper work roll 21*b* are moved by the movement device 22 in opposite directions, the distance between the facing edge portions of the work rolls 21 is changed and the slab X2 is rolled in accordance with a thickness variation over time of the edge portions.

Returning to FIG. 1, the guide device 3 guides the slab X2 and the thin plate X3. The guide device 3 includes: pinch rolls 31 that are disposed between the casting device 1 and the finishing milling device 2 and guide the slab X2; and a deflector roll 32 that is disposed between the finishing milling device 2 and the winding device 4, guides the thin plate X3, and imparts proper tension to the thin plate X3.

The winding device 4 collects the thin plate X3 exhausted from the finishing milling device 2 by winding it. The winding device 4 is arranged on the downstream side of the finishing milling device 2.

The thickness sensor 5 is arranged between the casting device 1 and the finishing milling device 2, and measures the thickness of the slab X2, and outputs the measurement result as a thickness signal.

The control device 6 controls a whole operation of the rolling mill S1 of the present embodiment. The control device 6 is electrically connected to the casting device 1, the finishing milling device 2, the guide device 3, the winding device 4, and the thickness sensor 5. The control device 6 controls the whole operation of the rolling mill S1 based on an instruction from the outside, a program previously stored, and the thickness signal that is input from the thickness sensor 5.

In the rolling mill S1 of the present embodiment, the control device 6 process the input thickness signal, to thereby obtain a thickness variation over time of the edge portions of the slab X2. In addition, when there is an instruction from the outside or after a predetermined lapse of time in the previously stored program, the control device 6 moves the work rolls 21 via the movement device 22 in accordance with the obtained thickness variation.

Next is a description of an operation of the rolling mill S1 of the present embodiment with the aforementioned construction.

First, the liquid metal X1 is continuously made into the slab X2 by the casting device 1.

To be more specific, the liquid metal X1 reserved in the tundish 11 is exhausted downward from the tundish 11 to be supplied to casting nozzle 12. Then, the liquid metal X1 supplied to the casting nozzle 12 is exhausted from the casting nozzle 12 to be supplied to the reservoir which is a space surrounded by the peripheral surfaces of the casting rolls 13 and the side weir 14. In addition, the liquid metal X1 is cast while being cooled between the casting rolls 13*a*, 13*b* which are rolling. As a result, the liquid metal X1 is made into the slab X2, and is exhausted downward from the casting rolls 13.

Subsequently, the slab X2 is continuously rolled and shaped by the finishing milling device 2 to be made into the thin plate X3.

To be more specific, the slab X2 is guided and supplied to the work rolls 21 by the pinch rolls 31 of the guide device 3. Then, the slab X2 supplied to the work rolls 21 is rolled between the lower work roll 21*a* and the upper work roll 21*b* to be made into the thin plate X3.

Here, in the rolling mill S1 of the present embodiment, the contour A of the peripheral surface of the work roll 21 is formed by overlapping the first contour B with the second contour C. The first contour B includes: the edge regions B2, B3 with a shape in accordance with an average value of the thickness variation in the edge portions so as to make uniform a rolling reduction in the width direction for the slab with an edge thickness equal to the average value; and the central region B1 between the edge regions B2, B3. The second contour C includes the edge regions C2, C3 which have an inclination angle steeper with respect to the axis direction than the central region C1 so that the distance between the facing edge portions of the lower work roll and the upper work roll will change when the work rolls are moved by the movement device in axially opposite directions.

Therefore, when not moved by the movement device 22, the work rolls 21 roll the slab X2 so that a rolling reduction in the width direction is uniform for the slab with an edge thickness equal to an average value of the thickness variation in the edge portions. On the other hand, when the lower work roll 21*a* and the upper work roll 21*b* are moved by the movement device 22 in opposite directions based on the thickness signal from the thickness sensor 5, the distance between the facing edge portions of the work rolls 21 is changed and the slab X2 is rolled in accordance with a thickness variation over time of the edge portions.

Furthermore, the first contour B and the second contour C both are generally smoothly continuous from one edge region to the other edge region. Therefore, the contour A in which the first contour B and the second contour C are overlapped is also generally smoothly continuous from the edge region A2 to the edge region A3. This makes the surface of the work roll 21 into a continuous curved surface. As a result, it is possible to roll the slab X2 with its surfaces smooth. Moreover, it is possible to manufacture the thin plate X3 that is smoothly continuous in its width direction.

The thin plate X3 exhausted from the finishing milling device 2 is imparted with a proper tension by the deflector roll 32, is then supplied to winding device 4. The thin plate X3 is wound and collected by the winding device 4.

According to the rolling mill S1 of the present embodiment as described above, the contour A of the work roll 21 has a shape in which the first contour B and the second contour C are overlapped. The first contour B includes: the edge regions B2, B3 with a shape in accordance with an average value of the thickness variation of the edge portions so as to make uniform a rolling reduction in the width direction for the slab with an edge thickness equal to the average value; and the central region B1 between the edge regions B2, B3. The second contour C includes the edge regions C2, C3 which have an inclination angle steeper with respect to the axis direction than the central region C1 so that the distance between the facing edge portions of the lower work roll and the upper work roll will change when the work rolls are moved by the movement device in axially opposite directions.

Therefore, the work roll 21 in the present embodiment has both the workings obtained when the rolls 100 whose peripheral surface has the first contour B are used as work rolls and the workings obtained when the rolls 200 whose peripheral surface has the second contour C are used as work rolls. That is, when not moved by the movement device 22, the pair of work rolls 21 of the present embodiment rolls the slab X2 so that a rolling reduction in the width direction is uniform for the slab with an edge thickness equal to an average value of thickness variation in the edge portions of the slab. In addition, when the lower work roll 21*a* and the upper work roll 21*b* are moved by the movement device 22 in opposite directions, the distance between the facing edge portions of the work rolls 21 is changed and the slab X2 is rolled in accordance with a thickness variation over time of the edge portions.

According to the rolling mill S1 of the present embodiment as described above, with the movement of the work rolls 21 by the movement device 22, it is possible to perform rolling in accordance with a thickness variation over time of the edge portions of the slab X2. Furthermore, even in the case where the work rolls 21 are not moved by the movement device 22, it is possible to perform rolling such that a rolling reduction in the width direction is uniform for the slab with an edge thickness equal to an average value of the thickness variation in the edge portions. A thickness variation over time in the edge portions of an actual slab (a slab whose edge thickness varies) is not significantly different from its average value. Therefore, even in the case where the work rolls 21 are not moved by the movement device 22, it is possible to roll the slab X2 to a degree that does not cause a deterioration in its quality.

Consequently, according to the rolling mill S1 of the present embodiment, even in the event of trouble in the movement device 22, it is possible to operate the rolling mill S1 without waiting for the recovery of the movement device 22.

In the actual operation of the rolling mill S1, there are cases where a preset quality of the final form of the thin plate X3 permits some degree of thickness variation in the edge portions. In such cases, it is possible to operate the rolling mill in a state where the movement device 22 is at rest, according to the present embodiment. Therefore, it is possible to reduce the frequency of use of the movement device 22. Hence, it is possible to reduce the amount of trouble in the movement device 22.

Consequently, according to the rolling mill S1 of the present embodiment, it is possible to reduce the amount of trouble in a rolling mill that is caused by the movement device provided in the rolling mill for moving its work rolls.

While a preferred embodiment according to the invention has been described above with reference to the accompanying drawings, this is not to be considered as a limitation of the invention. Shapes, combinations and the like of the constituent members illustrated above are merely examples, and various modifications based on design requirements and the like can be made without departing from the scope of the invention.

For example, in the above embodiment, the description has been for the construction in which the central region B1 of the first contour B is curved in a direction further away from the axis.

However, the present invention is not limited to this. The central region B1 of the first contour B is required only to be formed in accordance with the warpage of the work roll 21 at the time of rolling. For example, the central region B1 may be curved in a direction further closer to the axis. Alternatively, in the case no warpage of the work roll 21 is produced at the time of rolling, the central region B1 may be straight.

Furthermore, the central region C1 of the second contour C may not be substantially straight but curved, too.

Furthermore, in the above embodiment, the description has been for the case where the back-up roll 23 abutting on the work roll 21 is provided for the work roll 21 on one-on-one basis.

However, the present invention is not limited to this. A plurality of back-up rolls may be installed for one work roll 21.

INDUSTRIAL APPLICABILITY

According to the present embodiment, even in the event of trouble in the movement device, it is possible to operate the rolling mill without waiting for the recovery of the movement device.

Furthermore, according to the present embodiment, it is possible to reduce the amount of trouble in a rolling mill that is caused by the movement device provided in the rolling mill for moving its finishing milling rolls.

The invention claimed is:

1. A rolling mill, comprising:

a casting device that casts molten metal to form a slab with a predetermined width;

a pair of finishing milling rolls that shape the slab by rolling; and a movement device capable of moving the finishing milling rolls along respective axis directions thereof, wherein a contour of a peripheral surface of each of the finishing milling rolls has a shape in which a first contour and a second contour are overlapped, the first contour comprising: edge regions with a shape in accordance with an average value of thickness variation in edge portions so as to make uniform a rolling reduction in a width direction for the slab with an edge thickness equal to the average value; and a central region that is interposed between the edge regions, and the second contour comprising edge regions which have an inclination angle steeper with respect to the axis direction than a central region so that the distance between facing edge portions of one of the pair of finishing milling rolls and the other of the pair of finishing milling rolls changes when the finishing milling rolls are moved by the movement device in opposite directions.

2. The rolling mill according to claim 1, wherein the first contour has a shape axisymmetrical with respect to a line passing through a central position in a length direction along the axis of the finishing milling roll.

3. The rolling mill according to claim 1, wherein the second contour has a shape symmetrical with respect to a central position in a length direction along the axis of the finishing milling roll.

4. The rolling mill according to claim 1, wherein the central region of the first contour is curved in accordance with a warpage amount of the finishing milling roll at the time of rolling.

5. The rolling mill according to claim 1, wherein the first contour and the second contour are generally smoothly continuous.

6. The rolling mill according to claim 1, wherein the casting device continuously casts the metal, and the finishing milling rolls continuously shape the slab.

* * * * *